United States Patent [19]

Kocay

[11] 4,267,864

[45] May 19, 1981

[54] FABRIC SUITABLE FOR MAKING SANDBAGS AND METHOD FOR MAKING THE SAME

[75] Inventor: Witold R. Kocay, Pomfret, Conn.

[73] Assignee: Monsanto Company, St. Louis, Mo.

[21] Appl. No.: 43,603

[22] Filed: May 29, 1979

[51] Int. Cl.[3] ..... D03D 15/00; D03D 3/00; D02G 3/02; D02G 3/38

[52] U.S. Cl. ..... 139/420 R; 139/389; 139/426 R; 57/210; 57/244

[58] Field of Search ..... 139/420 R, 426 R, 389; 57/210, 211, 235, 243, 244

[56] References Cited

U.S. PATENT DOCUMENTS

| | | | |
|---|---|---|---|
| 3,360,014 | 12/1967 | Poisson et al. | 139/389 |
| 3,360,015 | 12/1967 | Hughes | 139/389 |
| 3,544,404 | 12/1970 | Johnson et al. | 139/389 X |
| 3,722,202 | 3/1973 | Indarte | 57/210 |
| 4,018,042 | 4/1977 | Maag et al. | 57/210 |

OTHER PUBLICATIONS

Orlon, Acrylic Fiber, Technical Mannual E. I. Du Pont de Nemours & Co. (Inc.), Section 2, pp. 2-501-502.

*Primary Examiner*—James Kee Chi

*Attorney, Agent, or Firm*—Robert L. Broad, Jr.; John W. Whisler

[57] ABSTRACT

A fabric suitable for use in making sandbags and the method of making the same wherein the fabric is woven from a yarn of twisted staple acrylic fibers having a fiber length of about 7 to 20 cm and a denier per filament of about 5 to 15, preferably 10 to 15, the yarn having a total denier of about 200 to 2650. The yarn is wrapped with a continuous filament yarn of a type which is degraded by ultraviolet light, with the wrapping being done in such a manner that fuzziness of the yarn is reduced to the point where the yarn can be woven into fabric without the use of size and at a weaving efficiency of at least about 70%.

7 Claims, 3 Drawing Figures

FABRIC SUITABLE FOR MAKING SANDBAGS AND METHOD FOR MAKING THE SAME

BACKGROUND OF THE INVENTION a. Field of the Invention

This invention relates to fabrics suitable for use in making sandbags and methods for making the same.

b. Description of the Prior Art

A fabric to be used in making sandbags must have several characteristics. It must not be degraded to any significant extent by sunlight. It must have a sufficiently close weave that sand or silt cannot leak or be washed from the bag by the action of water. Further, the fabric should have a relatively high strength.

It is known to make sandbag fabrics from low denier acrylic or modacrylic fibers, these fibers having an excellent resistance to sunlight. It is relatively easy, using fibers having a denier per filament of less than 5, to make sandbag fabric which is resistant to sunlight and which will retain either sand or clay. Conventionally, a sizing is applied to these yarns and the yarns are then woven into a fabric. Unfortunately, this fabric has several disadvantages. One disadvantage is the fact that size must be removed from the fabric before the fabric is used in order to prevent the formation of mildew and mold on the bag. Another disadvantage is that the use of the small denier per filament fibers results in a sandbag fabric which is easily cut or torn on construction sites and which does not have the outdoor durability that the bag would have if fibers of a greater denier were used.

If one attempts to make a sandbag fabric from staple fibers have a higher denier per filament, for example, 10 to 15 dpf, he encounters severe problems in weaving the yarn into the fabric. If no size is applied to the yarn prior to weaving, the hairiness or fuzziness of the yarn causes excessive down time on the weaving machine, resulting in a weaving efficiency which is probably less than about 40%. This is because the higher denier fibers are much stiffer, so that the yarn will not readily pass through the weaving machine. No improvement is seen when a size is applied to the yarns prior to weaving, since a warp made from the yarns exits from the slasher in almost the form of a solid bonded sheet. Separating the individual ends from this sheet causes even greater hairiness.

In the present invention, fibers of larger denier are used without sizing and with an increased weaving efficiency to make an improved fabric for use in making sandbags.

SUMMARY OF THE INVENTION

A fabric and the method for making the same, wherein the fabric is woven from a yarn made up of staple acrylic fibers wrapped with a continuous filament wherein the fibers have a length of 7 to 20 centimeters and a denier per filament of about 5 to 15, preferably 10 to 15, the yarn having a total denier of about 200 to 2650. The continuous filament is of a type which is degraded by sunlight and is wrapped around the staple fibers in such a manner that hairiness or fuzziness of the yarn is reduced to the point where the yarn can be woven into fabric with the weaving efficiency of at least about 70 percent, the yarn being free of size during the weaving.

DETAILED DESCRIPTION OF THE INVENTION

Figure 1:
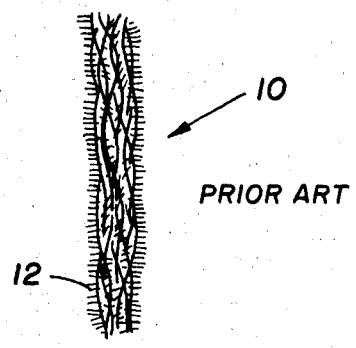
FIG. 1 shows a yarn made from high denier staple fibers and not carrying any wrapping or sizing.

Referring now in detail to the drawing, there is shown in FIG. 1 a yarn 10 made up of staple fibers having a denier per filament above about 5 and, preferably, 10 to 15. Ends 12 of the staple fibers protrude from the yarn as shown in FIG. 1 to give the yarn a hairy or fuzzy appearance. The protruding ends 12 of the fibers, being of greater stiffness than would be fibers of a lesser denier, cause serious difficulties in weaving a yarn of this type into fabric. If an attempt is made to apply a sizing to the yarn to reduce hairiness, the yarns exit from the slasher more or less in the form of a bonded sheet and when the individual yarns are torn from the sheet, even greater fuzziness or hairiness of the yarn is promoted. Weaving such a yarn into a fabric is very difficult, with much loom down time.

Figure 2:
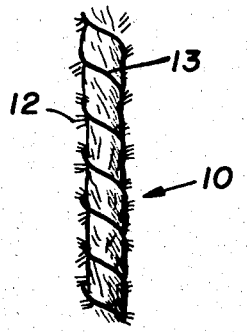
FIG. 2 shows the staple fiber yarn of FIG. 1 which has been wrapped with a continuous filament yarn to reduce the hairiness of the staple fibers.

The problems involved with weaving a yarn such as shown in FIG. 1 are substantially reduced by wrapping the yarn with a continuous filament yarn 13 as shown in FIG. 2. In the yarn wrapping process, the continuous filament yarn 13 is swept around the staple fibers as it is wrapped onto the staple fibers and movement of the continuous filament yarn 13 pulls a large percentage of the free ends 12 down into contact with the fiber bundle to substantially reduce the hairiness or fuzziness of the yarn. The yarn, after being wrapped with the continuous filament yarn 13, is woven into a fabric on a conventional loom.

In a second embodiment of the invention the staple fibers are wrapped with a flat continuous filament or ribbon 16 to even greater reduce the hairiness of the yarn for even greater weaving efficiency.

Figure 3:
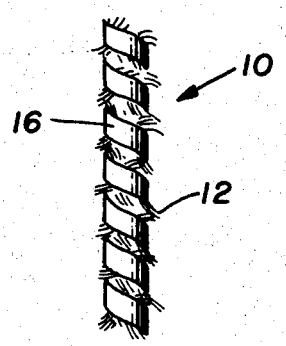
FIG. 3 shows another embodiment of the wrapped yarn of FIG. 2 wherein a band or ribbon is used for wrapping the staple yarn.

The yarns shown in FIGS. 2 and 3 are woven into a fabric on a conventional loom in a conventional manner to form a fabric which may be used to make sandbags. Because of the reduced hairiness of the yarn, a weaving efficiency in excess of about 70% can be achieved. This is contrasted with a weaving efficiency of less than about 40% when an attempt is made to weave the unwrapped yarn of FIG. 1 into a fabric.

Weaving efficiency is determined by the amount of time the weaving machine is out of operation. A weaving efficiency of 70% means that the machine is in operation and producing fabric 70% of a given time period and is out of operation the other 30%.

The wrapping filament 13 or ribbon 16 is made from a material which will be degraded and, in effect, destroyed by sunlight. Suitable filaments may be made from cellulosics, polyamides, polyesters, polyvinyls and polyolefins of a fiber-forming type.

Over a period of time, sunlight will degrade and destroy the continuous filament yarn 13, or the flat ribbon-like yarn 16, and the yarn 10 will be free to return to its original hairy or fuzzy condition to enhance the ability of the sandbag to retain sand or slit.

What is claimed is:

1. The method for making fabric suitable for use in making sandbags, comprising weaving a fabric from a yarn made up of staple acrylic fibers wrapped with a continuous filament, said fibers having a length of 7 to 20 centimeters and a denier per filament of about 10 to 15, said yarn having a total denier of about 200 to 2650, said continuous filament being of a type which is degraded by sunlight, said continuous filament being wrapped around the staple fibers in such a manner that hairiness of the yarn is reduced to the point where the yarn can be woven into fabric with a weaving efficiency of at least about 70%, said yarn being free of size during said weaving.

2. The method of claim 1 wherein the continuous filament is selected from the group consisting of cellulosic, polyamide, polyester, polyvinyl and polyolefin.

3. The method of claim 2 wherein the continuous filament is a polyamide.

4. A woven fabric made from a yarn made up of staple acrylic fibers having a denier per filament of 10 to 15 and a total denier of about 200 to 2650 having a denier per filament of 5 to 15 and a total denier of from about 200 to about 2650, said fibers being wrapped with a continuous filament of a type which is degraded by sunlight, said staple fibers being wrapped in such a manner that fuzziness of the fibers is reduced to the extent that the yarn can be woven into said fabric at a weaving efficiency of at least about 70%.

5. The fabric of claim 4 wherein the continuous filament is selected from the group consisting of celluloses, polyamides, polyesters, polyvinyls and polyolefins.

6. The fabric of claim 5 wherein the continuous filament is polyamide.

7. The fabric of claim 5 wherein the continuous filament is in the form of a flat ribbon.

* * * * *